US009162366B2

(12) United States Patent
Hung

(10) Patent No.: US 9,162,366 B2
(45) Date of Patent: Oct. 20, 2015

(54) PLASTIC FILM TEAR LINE FORMING DEVICE

(76) Inventor: Tzu-Chin Hung, New Taipei (TW)

( * ) Notice: Subject to any disclaimer, the term of this patent is extended or adjusted under 35 U.S.C. 154(b) by 613 days.

(21) Appl. No.: 13/568,437

(22) Filed: Aug. 7, 2012

(65) Prior Publication Data

US 2013/0319202 A1 Dec. 5, 2013

(30) Foreign Application Priority Data

May 31, 2012 (TW) ..... 101210481 U

(51) Int. Cl.

| | |
|---|---|
| ***B26F 1/14*** | (2006.01) |
| ***B26F 1/18*** | (2006.01) |
| ***B26D 3/08*** | (2006.01) |
| ***B26F 1/02*** | (2006.01) |

(52) U.S. Cl.

CPC ... *B26F 1/14* (2013.01); *B26F 1/02* (2013.01); *B26D 3/085* (2013.01); *B26F 1/18* (2013.01); *Y10T 83/0333* (2015.04); *Y10T 83/2155* (2015.04); *Y10T 83/8831* (2015.04); *Y10T 83/9314* (2015.04)

(58) Field of Classification Search

CPC ..... B26F 1/02; B26F 1/14; B26F 1/18; B65D 5/54; Y10T 83/8831; Y10T 83/2144; Y10T 83/2159; Y10T 83/9314; Y10T 83/9449; Y10T 83/0252; Y10T 83/943; Y10T 83/944; Y10T 83/2166; Y10T 83/9425; Y10T 83/9454; B26D 3/08; B26D 3/14

USPC ..... 83/866, 868, 179, 880, 882, 883, 30, 83/879, 140, 133, 127, 406, 406.1, 918, 83/917, 660, 620, 692, 695; 242/526, 242/526.1; 225/2

See application file for complete search history.

(56) References Cited

U.S. PATENT DOCUMENTS

| | | | | | |
|---|---|---|---|---|---|
| 348,434 | A | * | 8/1886 | Wallace | 83/133 |
| 1,660,387 | A | * | 2/1928 | Masel | 83/451 |
| 1,724,358 | A | * | 8/1929 | Messer | 83/387 |
| 3,255,949 | A | * | 6/1966 | Buttery | 428/43 |
| 3,802,308 | A | * | 4/1974 | Davis, Jr. | 83/99 |
| 4,742,742 | A | * | 5/1988 | Yokoe | 83/101 |
| 4,951,967 | A | * | 8/1990 | Michalik | 281/2 |
| 5,190,087 | A | * | 3/1993 | Mike | 144/91 |
| 5,492,041 | A | * | 2/1996 | Valkanov | 83/133 |

FOREIGN PATENT DOCUMENTS

| | | | | |
|---|---|---|---|---|
| EP | 2050681 | * | 4/2009 | B65D 5/54 |

* cited by examiner

*Primary Examiner* — Laura M Lee
(74) *Attorney, Agent, or Firm* — Rosenberg, Klein & Lee

(57) ABSTRACT

A plastic film tear line forming device includes a chassis, at least one vertical driver, a first cutter, and a second cutter. The chassis forms at least one opening adapted to receive a plastic film to feed therethrough. The vertical driver is mounted to the chassis. The first cutter is arranged above the opening of the chassis and is driven by the vertical driver to do a vertical movement. The first cutter has a lower end forming a plurality of first teeth, which defines therebetween first gaps. The second cutter is mounted to the chassis to be located below the opening and has an end forming a plurality of second teeth, which defines therebetween second gaps. When a plastic film is fed into the chassis through the opening, the vertical driver drives the first cutter vertically downward to penetrate through the plastic film.

2 Claims, 8 Drawing Sheets

PLASTIC FILM TEAR LINE FORMING DEVICE

BACKGROUND OF THE INVENTION

1. Field of the Invention

The present invention relates to a plastic film tear line forming device, and in particular to a device that is applicable to a tubular product-packaging plastic film and comprises two cutters forming teeth and gaps in a right-angle angularly offset arrangement in order to form a horizontal circumferentially-extending ring like tear line in two sides of the plastic film.

2. The Related Arts

Plastic packaging films have been widely used in outside packaging of containers, such as bottles and cans of beverage products. Particularly, tear lines must be provided in the portion of the plastic packaging film that corresponds to the bottle cap or can cover to allow a user to tear off the plastic film along the tear line for opening the bottle cap or can cover. An example is shown in Taiwan Patent No. 428761, which discloses an easy-tearing laser counterfeit-proof label for bottle containers, in which a conventional packaging label for cap portions of bottles and cans is provided. Such a horizontal tearing line mode only suits for localized packaging for containers, such as bottles and cans, and is not applicable to a complete sheet of plastic film for packaging the whole bottle body or can body. A packaging mode of two-section plastic film or two sheets of plastic film must be employed. This increases the volume of the packaging material and cost, making it uneconomic.

Further, an improvement over the above described is illustrated in FIG. 1 of the attached drawings, in which a pad A is provided to receive a plastic film B to pass thereon. A tear-line cutter C is located above the plastic film B and is depressed downward onto the plastic film B so as form tear lines D1, D2 respectively on opposite sides of the plastic film B. The tear-line cutter C, when depressed down onto the plastic film B, provides different penetrating forces to the two sides of the plastic film B, whereby the upper side of the plastic film B is completely penetrated through by the tear-line cutter C, but the lower side of the plastic film B is not because the tear-line cutter C is blocked by the pad A. Consequently, the perforation size and density of the tear lines D1, D2 are different (as shown in FIG. 2). This makes the tear strengths and the tensions of the upper and lower sides of the plastic film B different from each other. When the plastic film B is processed by a packaging machine to fit over the surface of a bottle or can, one of the sides may be unexpectedly torn off or broken. This affects the packaging quality of the plastic film. Further, the repeated collision between the tear-line cutter C and the pad A easily causes fast wear of the tear-line cutter C, making it necessary to frequently change the tear-line cutter C. As a consequence, installation cost of tear line forming facility of the plastic film B would be greatly increased.

Further, known prior art references, such as Taiwan Utility Model M284625, which discloses a tearing device of label fitting machine, teach arrangement of rollers and tear rollers in a label fitting machine in order to form longitudinal or lateral tear lines in a plastic packaging film. However, those known reference employ processes for forming tear lines in a plastic film that, similar to what shown in FIGS. 1 and 2, lead to different perforation sizes and density of the tear lines formed in the upper and lower sides of the plastic film. Thus, when the plastic film is processed by a packaging machine to fit over a bottle, the plastic film is stretched by the packaging machine and due to the differences of tear line tensions or stresses between the upper and lower sides of the plastic film, it easily occurs that one side of the plastic film is torn or broken.

SUMMARY OF THE INVENTION

The conventional plastic film tear line forming device described in the above mentioned techniques or prior art references do not provide a plastic film that can be fit over a bottle or can in the form of a single complete sheet of plastic film or that does not cause undesired tearing or breaking problem when the plastic film is processed in a packaging machine to fit over a bottle or can due to different tensions or stresses induced in the two sides of the plastic film by difference of perforation sizes and densities of the tear lines and does not cause fast wear of tear-line cutter that requires frequent replacement of the tear-line cutter and increases the installation cost.

Thus, the present invention provides a plastic film tear line forming device, which comprises a chassis, at least one vertical driver, a first cutter, and a second cutter. The chassis forms at least one opening for receiving a plastic film to feed therethrough. The vertical driver is mounted to the chassis. The first cutter is arranged above the opening of the chassis and is driven by the vertical driver to do a vertical movement. The first cutter has a lower end forming a plurality of first teeth, which defines therebetween a plurality of first gaps. The second cutter is mounted to the chassis to be located below the opening and has an end forming a plurality of second teeth, which defines therebetween a plurality of second gaps. When a plastic film is fed into the chassis through the opening, the vertical driver drives the first cutter vertically downward to contact the plastic film and makes the first gaps respectively engage the second teeth and the first teeth engaging the second gaps of the second teeth to thereby completely penetrate through two sides of the plastic film to form a circumferential ring like tear line in the two sides of the plastic film.

The effectiveness of the plastic film tear line forming device according to the present invention is that through mutual engagement between the first teeth and the first gaps of the first cutter and the second gaps and the second teeth of the second cutter and by arranging the first cutter in a 90-degree angularly offset relationship with respect to the second cutter, when a tubular plastic film is fed between the first cutter and the second cutter, the first teeth are caused to engage the second gaps of the second cutter so as to allow upper and lower sides of the plastic film to be completely penetrated through by the first teeth and the tear lines in the two sides of the plastic film are completely identical in respect of perforation size, density, tension, and stress. Thus, undesired tearing or breaking of a plastic film can be completely eliminated when the plastic film is processed by a packaging machine to fit over a bottle or can. Further, the undesired collision between the first cutter and the second cutter can also be avoided to thereby extend lifespan of the first cutter and the second cutter.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
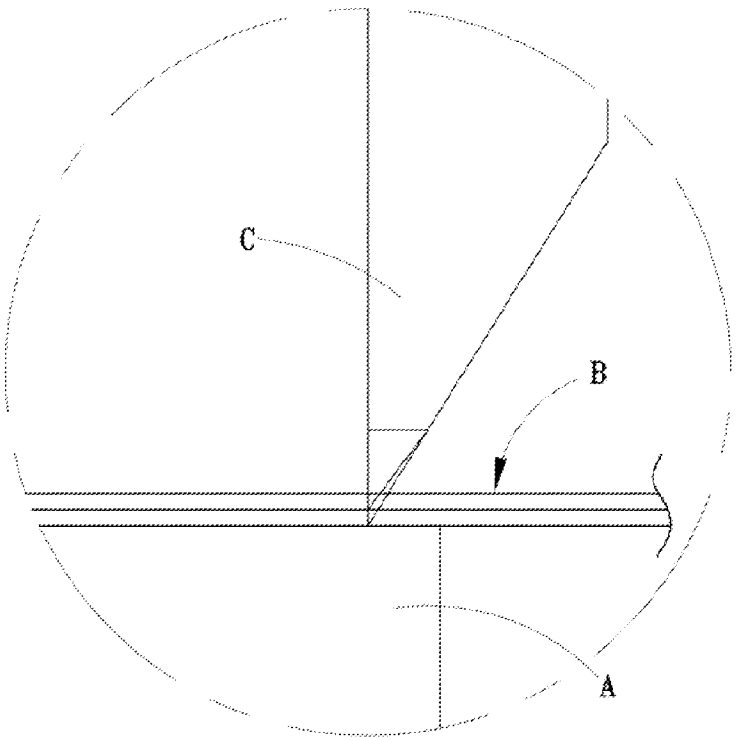
FIG.1 Prior Art
FIG. 1 is a side elevational view showing a situation where a cutter of a conventional plastic film tear line forming device penetrating through a plastic film and stopped by a pad.
Figure 2:
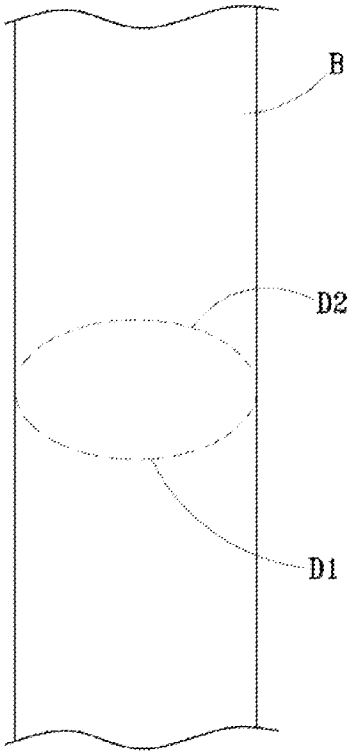
FIG.2 Prior Art
FIG. 2 is a schematic view showing a tube formed from the plastic film that is processed by the conventional plastic film tear line forming device of FIG. 1 and shows perforations of non-uniform tension and stress and non-identical perforation around the circumference of the tube.
Figure 3:
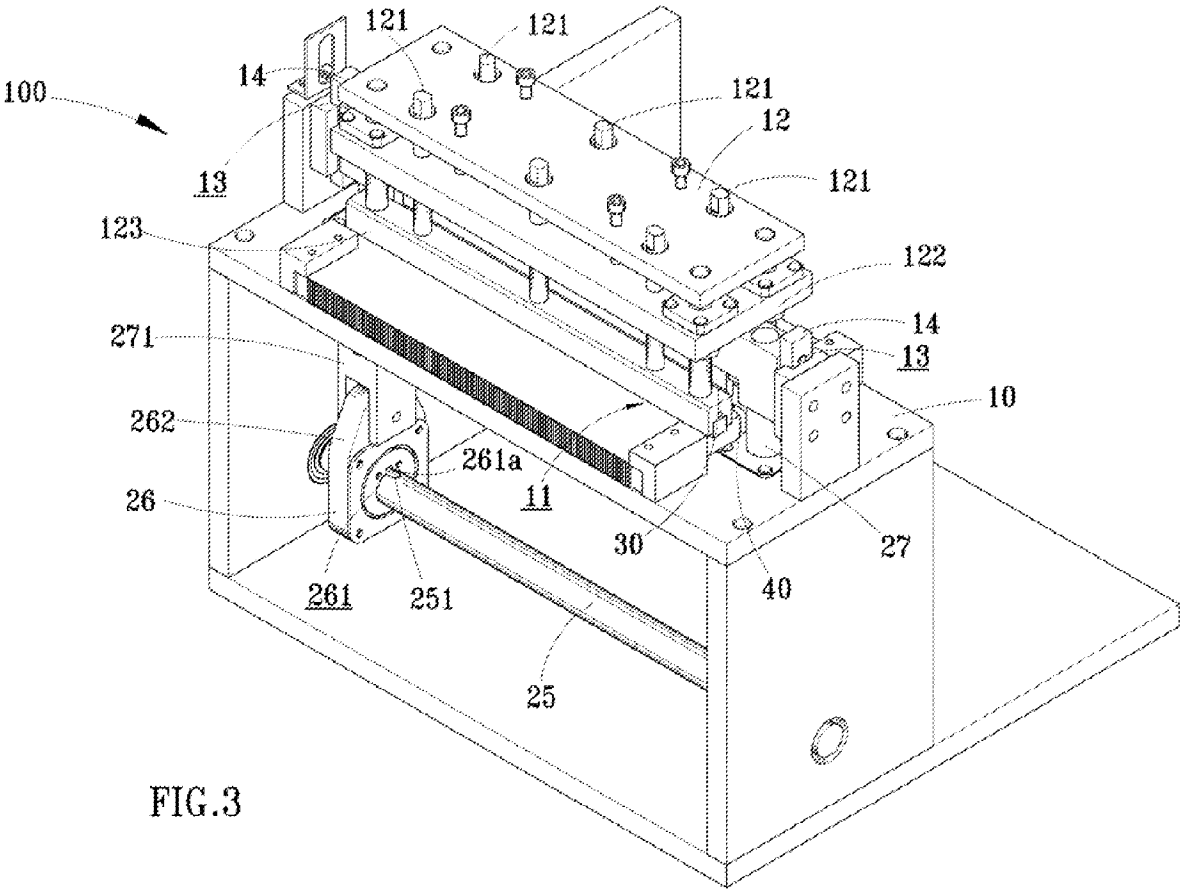
FIG. 3 is a perspective view showing a plastic film tear line forming device according to the present invention.
Figure 4:
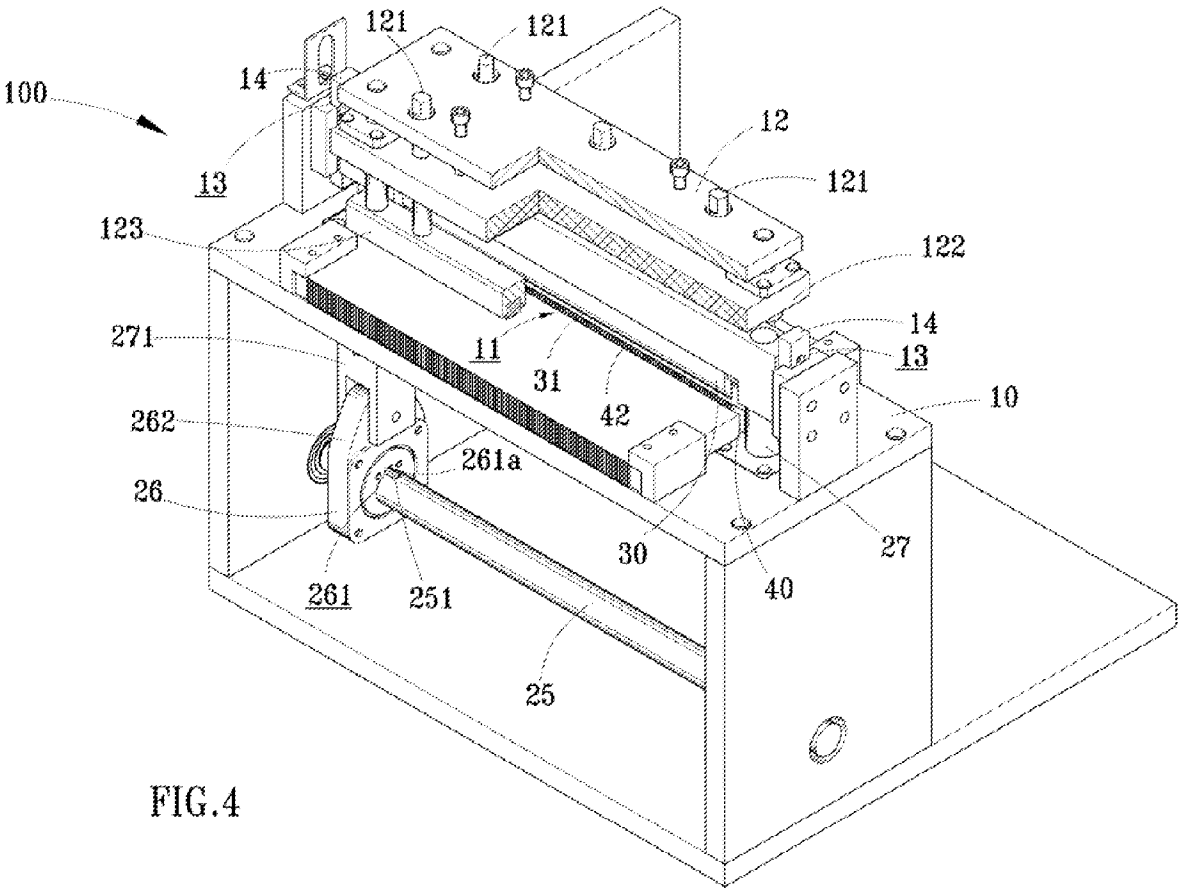
FIG. 4 is a perspective view similar to FIG. 3, showing 90-degree angularly offset arrangement between first and second cutters of the plastic film tear line forming device of the present invention.
Figure 5:
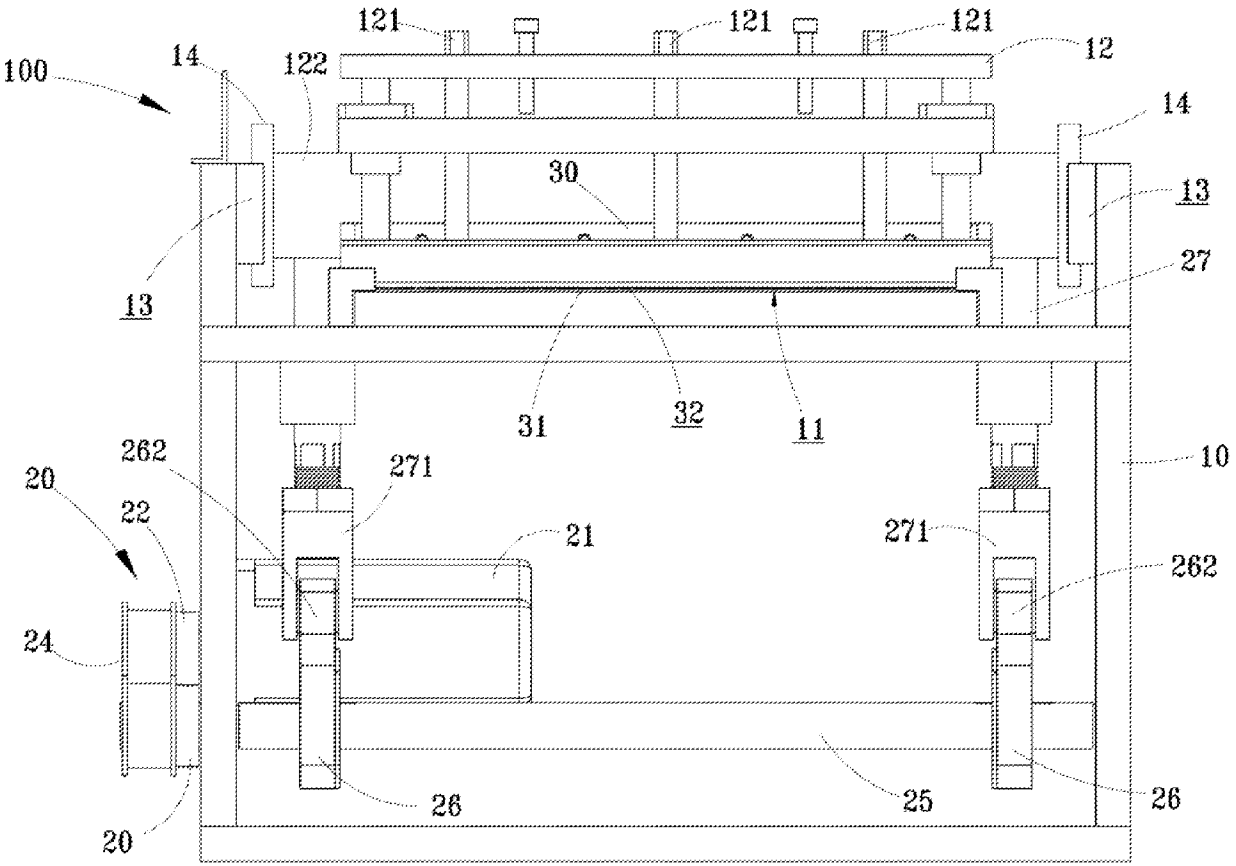
FIG. 5 is a front view of the plastic film tear line forming device according to the present invention.

With reference to the drawings and in particular to FIGS. 3, 4, and 5, the present invention provides a plastic film tear line forming device 100, which comprises a chassis 10, which forms at least one opening 11 for receiving a plastic film 200 to be fed therein. A fixed seat 12 is arranged above the chassis 10 and the fixed seat 12 comprises a plurality of vertical rails 121 extending downward. Each of the vertical rails 121 extend downward through a first movable seat 122 and a second movable seat 123, whereby the first movable seat 122 and the second movable seat 123 are movable in an up-down direction along the vertical rails 121. Guide rails 13 are respectively provided at two sides above the chassis 10. The first movable seat 122 has two opposite ends to each of which at least one guide block 14 is mounted, whereby an opposite side of each guide block 14 mates the respective the guide rail 13 to stabilize the first movable seat 122 and the second movable seat 123 and limit the strokes of the up-down direction movements thereof.

At least one vertical driver 20 is provided, which is not limited to any specific form and comprises, in an embodiment of the present invention, a driving motor 21, two pulleys 22, 23, a belt 24, a rotation shaft 25, two cams 26, and two resilient connection bars 27. The driving motor 21 is mounted rearward of a bottom portion of the chassis 10. The pulleys 22, 23 are arranged at one side of the chassis 10 and the pulley 22 is coupled to a spindle of the driving motor 21. The belt 24 connects between the pulleys 22, 23 to allow the pulleys 22, 23 to be driven by the driving motor 21 to rotate. The rotation shaft 25 has two ends respectively and rotatably mounted to two sides of the bottom portion of the chassis 10. One of the ends of the rotation shaft 25 is coupled to the pulley 23, whereby the rotation shaft 25 is driven by the pulley 23 to rotate. The two ends of the rotation shaft 25 are each provided, at an inward location, with a key 251.

Each cam 26 has a lower end forming a bore 261 and a notch 261*a* is formed in an upper side of the bore 261. The bores 261 of the cams 26 are fit to the ends of the rotation shafts 25 and the notches 261*a* receive keys 251 of the rotation shaft 25 to fit therein so as to couple the cams 26 to the rotation shaft 25 at locations inwardly of the two ends. Each cam 26 also comprises a rotary joint section 262 in an upper portion thereof. Each of the resilient connection bars 27 is provided with a resilient restoration force and has an end coupled to a bottom of the first movable seat 122 and an opposite end forming a coupling section 271, which is rotatably coupled to the rotary joint section 262 of the respective cam 26, whereby angular displacement of the cams 26 drives vertical linear movement of the resilient connection bars 271, which in turn causes the first movable seat 122 and the second movable seat 123 to do corresponding vertical movement in unison therewith.

The vertical driver 20 is not limited to a combination of a driving motor 21, two pulleys 22, 23, a belt 24, a rotation shaft 25, two cams 26, and two resilient connection bars 27 and other vertical linear driving device, such as pneumatic measures, for example pneumatic cylinder, and solenoid are equally applicable ad are considered within the scope of the present invention.

At least one first cutter 30 has an upper end coupled to the bottom of the first movable seat 122 of the chassis 10 and a lower end forming a plurality of first teeth 31. The first teeth 31 are arranged to space from each other so as to form therebetween a plurality of first gaps 32 (see FIG. 6).

At least one second cutter 40 is fixed to the chassis 10 at a location below the opening 11. The second cutter 40 has an end forming a plurality of second teeth 41, which is spaced from each other so as to form a plurality of second gaps 42 between the second teeth 41 (see FIG. 6). The second teeth 41 and the second gaps 42 are arranged to be 90-degree angularly offset with respect to the first teeth 31 and the first gaps 32 of the first cutter 30 (see FIG. 4).

Figure 6:
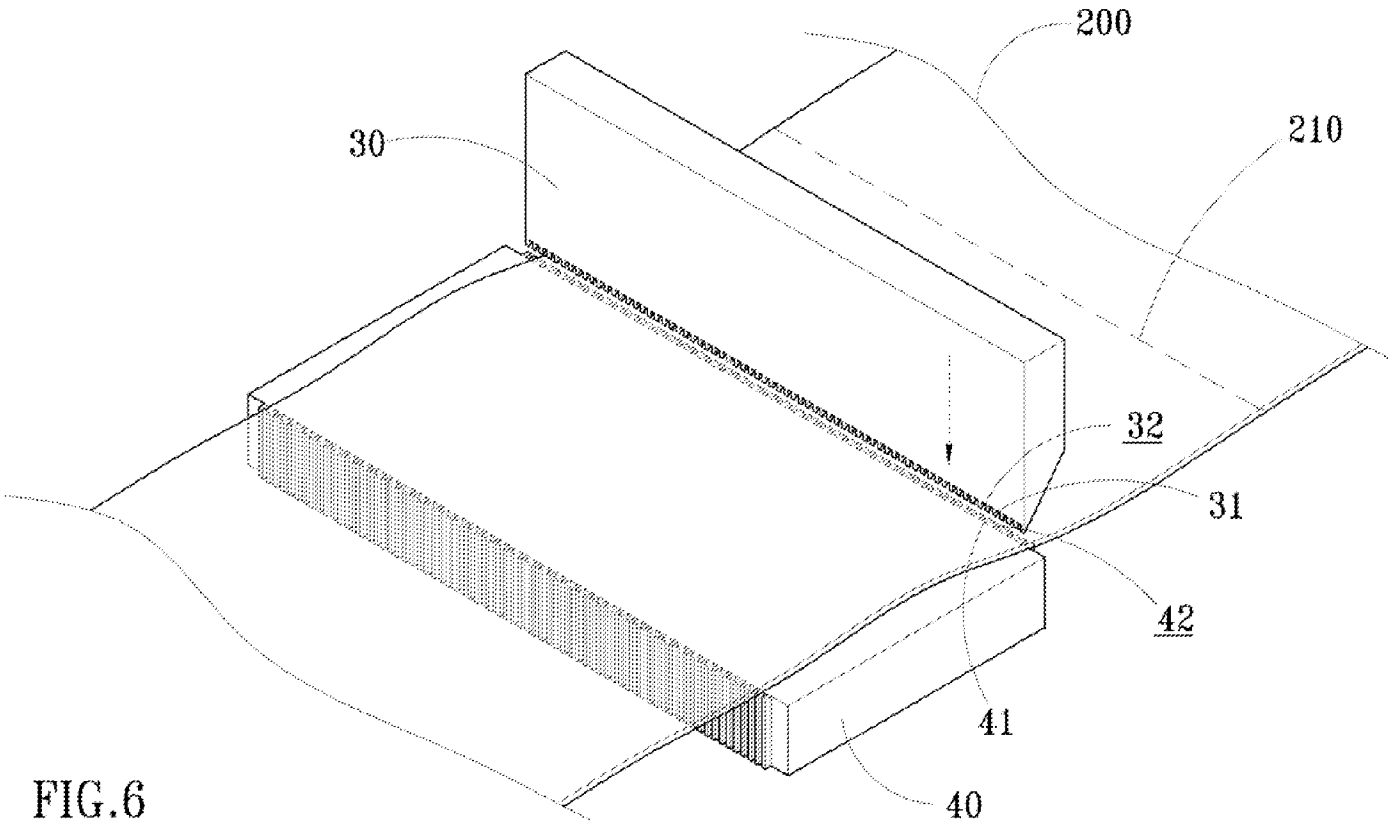
FIG. 6 is a partial enlarged view showing an example of application of the plastic film tear line forming device according to the present invention.
Figure 7:
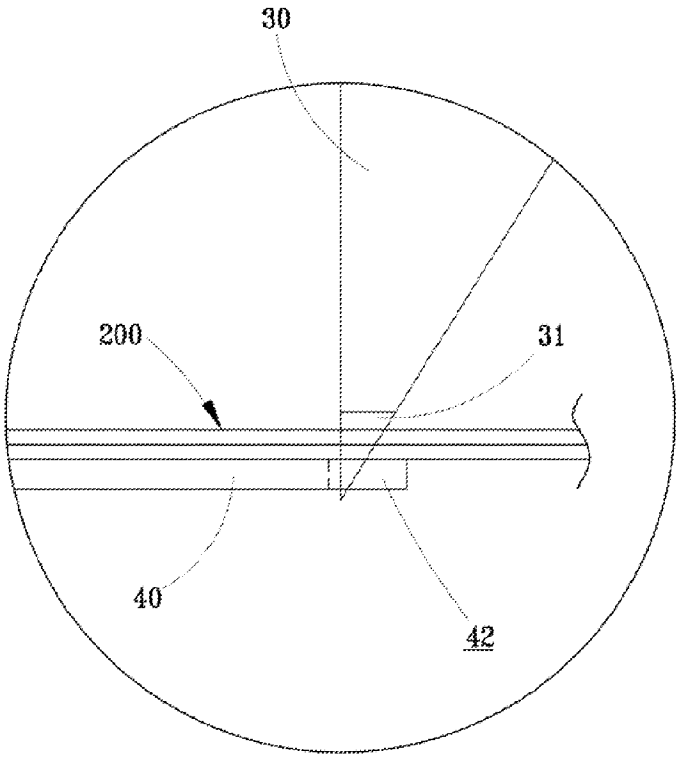
FIG. 7 is a partial side elevational view showing first teeth of the first cutter of the present invention completely penetrating upper and lower sides of a tubular plastic film and engaging second gaps of the second cutter.
Figure 8:
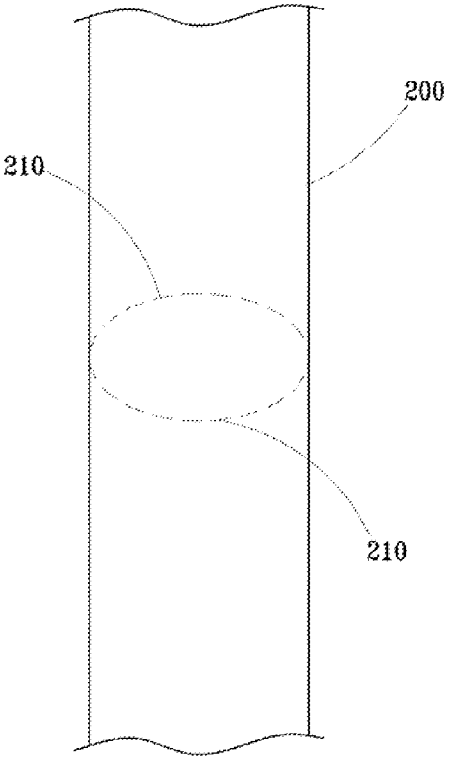
FIG. 8 is a schematic view showing a tube formed from the plastic film that is processed by the plastic film tear line forming device according to the present invention and shows perforations of uniform tension and stress and identical perforation around the circumference of the tube.

Referring to FIGS. 6, 7, and 8, an example of application of the plastic film tear line forming device 100 according to the present invention is shown, in which a plastic film 200 is shown fed into the chassis 10 from the front side of the opening 11 and the driving motor 21 of the vertical driver 20 takes forward rotation to have the rotation shaft 25 drive the cams 26 to rotate forward. The resilient connection bars 27 take vertically lowering linear movement to move the first movable seat 122 and the second movable seat 123 downward. Under the condition, the second movable seat 123 press down on a front section of the plastic film 200 and the first teeth 31 of the first cutter 30 of the first movable seat 122 completely penetrate through upper and lower sides of a rear section of the plastic film 200 (see FIG. 7) and respectively engage the second gaps 42 formed at one end of the second cutter 40. Similarly, the second teeth 41 of the second cutter 40 also respectively engage the first gaps 32 of the first cutter 30, whereby the upper and lower sides of the rear section of the plastic film 200 both form tear lines 210 of identical tension and stress and also of identical perforation size (see FIG. 8).

After the formation of the tear lines 210, the driving motor 21 is caused to rotate in a reversed direction to make the rotation shaft 25 and the cams 26 rotating reversely. The resilient connection bars 27 are returned to original position by the resilient force. The first movable seat 122 and the second movable seat 123 are moved upward in linear vertical movement to disengage from the plastic film 200 and return to the original positions. Further, the first teeth 31 and the first gaps 32 of the first cutter 30 are separated from the second gaps 42 and the second teeth 41 of the second cutter 40.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A plastic film tear line forming device, comprising:

a chassis, which forms at least one opening adapted to receive a flattened tubular plastic film to feed therethrough, a fixed seat being arranged above the chassis, the fixed seat comprising a plurality of vertical rails extending downward, each of the vertical rails extending downward through a first movable seat and a second movable seat, whereby the first movable seat and the second movable seat are movable in an up-down direction along the vertical rails;

at least one vertical driver, which is mounted to the chassis;

at least one first cutter, which is arranged above the opening of the chassis and is driven by the vertical driver to do a vertical movement, the first cutter having a lower end forming a plurality of first teeth, the first teeth defining therebetween a plurality of first gaps; and at least one second cutter, which is mounted to the chassis to be located below the opening, the second cutter having an end forming a plurality of second teeth, the second teeth defining therebetween a plurality of second gaps, the second teeth and the second gaps being arranged to be 90-degree angularly offset with respect to the first gaps and the first teeth of the first cutter, whereby when the first cutter is vertically moved downward, the first teeth are allowed to penetrate upper and lower layers of the flattened tubular plastic film to engage with the second gaps of the second cutter with the second teeth of the second cutter engaging the first gaps of the first cutter to form tear lines of uniform perforation size in both the upper and lower layers of the flattened tubular plastic film;

wherein the vertical driver comprises:

a driving motor, which is mounted rearward of a bottom portion of the chassis;

two pulleys, which are arranged at one side of the chassis, one of the pulleys being coupled to a spindle of the driving motor;

a belt, which connects between the pulleys to allow the pulleys to be driven by the driving motor to rotate;

a rotation shaft, which has two ends respectively and rotatably mounted to two sides of the bottom portion of the chassis, one of the ends of the rotation shaft being coupled to one of the pulleys, whereby the rotation shaft is driven by the pulley to rotate, the two ends of the rotation shaft being each provided, at an inward location, with a key;

two cams, each of which has a lower end forming a bore with a notch being formed in an upper side of the bore, the bores being respectively fit to the ends of the rotation shafts, the notches receiving keys of the rotation shaft to fit therein so as to couple the cams to the rotation shaft at locations inwardly of the two ends, each of the cams comprising a rotary joint section in an upper portion thereof; and two resilient connection bars, each of which is provided with a resilient restoration force and has an end coupled to a bottom of the first movable seat and an opposite end forming a coupling section, which is rotatably coupled to the rotary joint section of the respective cam, whereby angular displacement of the cams drives vertical linear movement of the resilient connection bars, which in turn causes the first movable seat and the second movable seat of the chassis to do corresponding vertical movement in unison therewith.

2. The plastic film tear line forming device as claimed in claim 1, wherein guide rails are respectively provided at two sides above the chassis and the first movable seat has two opposite ends to each of which at least one guide block is mounted, whereby an opposite side of each guide block mates the respective the guide rail to stabilize the first movable seat and the second movable seat and limit strokes of the up-down direction movements thereof.

* * * * *